US006162003A

United States Patent [19]

Grüner

[11] Patent Number: 6,162,003

[45] Date of Patent: Dec. 19, 2000

[54] INSTALLATION FOR STORING OBJECTS, ESPECIALLY BOATS

[76] Inventor: Friedrich Grüner, P.O. Box 39, 78253 Eigeltingen, Germany

[21] Appl. No.: 09/155,229

[22] PCT Filed: Mar. 14, 1997

[86] PCT No.: PCT/EP97/01302

§ 371 Date: Sep. 23, 1998

§ 102(e) Date: Sep. 23, 1998

[87] PCT Pub. No.: WO97/35760

PCT Pub. Date: Oct. 2, 1997

[30] Foreign Application Priority Data

Mar. 23, 1996 [DE] Germany ..... 196 11 485

[51] Int. Cl.[7] ..... B63C 15/00; E04H 6/18

[52] U.S. Cl. ..... 414/281; 277/284; 277/264

[58] Field of Search ..... 414/277, 281, 414/282, 284, 234, 239, 264

[56] References Cited

U.S. PATENT DOCUMENTS 4,640,214 2/1987 Bruns .

FOREIGN PATENT DOCUMENTS 3937097 5/1990 Germany .
4217109 11/1993 Germany .
366876 3/1991 Japan ..... 414/277
244180 7/1970 Russian Federation ..... 414/281

*Primary Examiner*—Steven A. Bratlie
*Attorney, Agent, or Firm*—Reid Law, L.L.C.; John S. Reid

[57] ABSTRACT

In an installation for the storage of objects, in particular for boats (8), numerous cells (1) are arranged next to and/or above each other for the accommodation of an object, in particular of a boat (8).

14 Claims, 4 Drawing Sheets

INSTALLATION FOR STORING OBJECTS, ESPECIALLY BOATS

Figure 1:
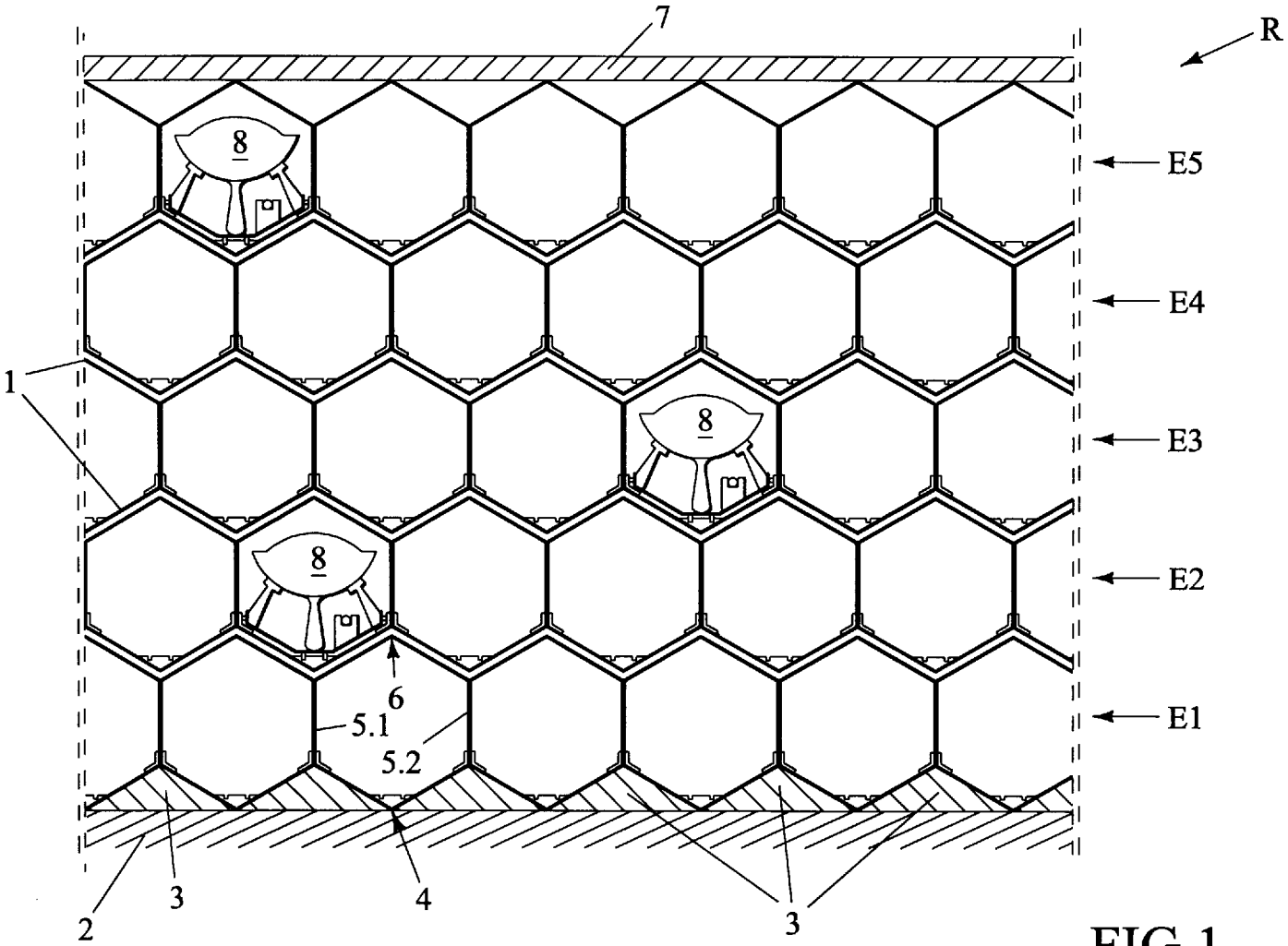

The invention relates to installations for the storage of objects, in particular for boats. Installations for the storage of boats are known from documents U.S. Pat. No. 4,640,214 and DE 39 37 097 A1. However, the present invention shows significant advantages in comparison to the inventions described in the above mentioned documents, these advantages are described in the following description; especially the movable storage elements.

Such installations serve for example for the storage of boats, such as sailing yachts, motor boats or similar. For example in autumn the boat is removed from the water with a trailer and is transported into a hall or a similar place of storage and left there for storage over the winter. In such halls or places of storage, the boats can be maintained, repaired and refurbished.

The disadvantage of this practice is that the trailer with which the boats are transported and stored takes up very much space in the hall. For this reason, it is common practice today for yachts when being stored in halls to be taken from their trailer, placed on their keels and to be supported using lateral supports in order to accommodate the maximum number of boats in the hall.

Boat builders and boat wharves in particular have major problems with storage space as they are often located close to the water. They have far too little space, for example, when the boats are removed from the water over winter and are stored to be able to easily carry out repairs. It is also disadvantageous that if work is carried out in the boat storage halls, then the other yachts become significantly dirty. For this reason, they must be specially covered.

The present invention is based on the problem of solving the above mentioned disadvantages and on creating an installation with which numerous boats, but also other objects can be stored quickly, and most importantly, requiring little space. Easy access to the stored boats or the stored objects should be possible.

This problem is solved by arranging numerous cells in a honeycomb fashion next to and/or above each other.

The present invention permits numerous boats to be stored preferably in hexagonal cells which are stacked in a honeycomb fashion next to and above each other. The individual cells are hereby formed in any desired length, such that when necessary, two boats can be inserted into the tubular cells using the appropriate storage trolleys. Also an arrangement of the cells in many levels of the individual cells stacked upon each other is desirable.

In the individual cells, storage trolleys are mounted which are fitted with slots and guide rails, into which the storage trolleys can be driven. These storage trolleys serve the support and easy handling of objects, in particular boats.

In order to support the boat in position, lateral brackets with arms connected to them are mounted on to a base plate on the storage trolley, which support the boat using so called adjustable supports. These supports are held by adjustable struts, so that an exact positioning of the supports on the hull of the boat is possible. To ensure that the surface of the hull is not damaged, padded blocks are provided on the ends of the supports that support the boat. In the case of a sailing yacht, the keel stands preferably on the base plate of the storage trolley, so that most of the weight, respectively the centre of gravity is carried by the base plate. In order to accommodate the mast and the boom on the storage trolley, mounting blocks or similar are provided if necessary.

To extract a boat out of such a cell, an appropriate lifting device is provided which is fitted with a lift suitable for receiving the storage trolley. This lifting device is raised to the height of the cell so that the storage trolley complete with the boat can be driven onto the lifting device, which then transports the storage trolley and the boat to the working area. Here, it is also conceivable that a crane lift the boat on the storage trolley from the lifting device onto a trailer.

That the individual cells can be locked up using locking mechanisms, gates, or similar items, which are not shown in the drawings, also lies within the scope of the present invention. In addition to this, lying within the scope of the present invention is that different arrangements of cells beside each other and above each other, which form a unit or a hall, are possible, whereby it is particularly advantageous if a single lifting device can be driven along a driveway and that on both sides of the lifting device cells are arranged so that a large number of boats and other objects can be stored.

Other polygon cell cross sections lie also within the scope of the present invention for the storage, for example, of boats or other objects. It is however to be especially emphasised that the present preferred hexagonal structure has proved to be the only static self supporting structure.

With the present invention an installation has been created which makes it possible to store a large number of boats within a very limited space. Besides this, every boat or every cell respectively is easily and quickly accessible, so that also in the case of repairs or maintenance every boat can be removed from its cell for this purpose. Should, for example, all the boats be in the water, then other objects can be stored in the cells.

Figure 2:
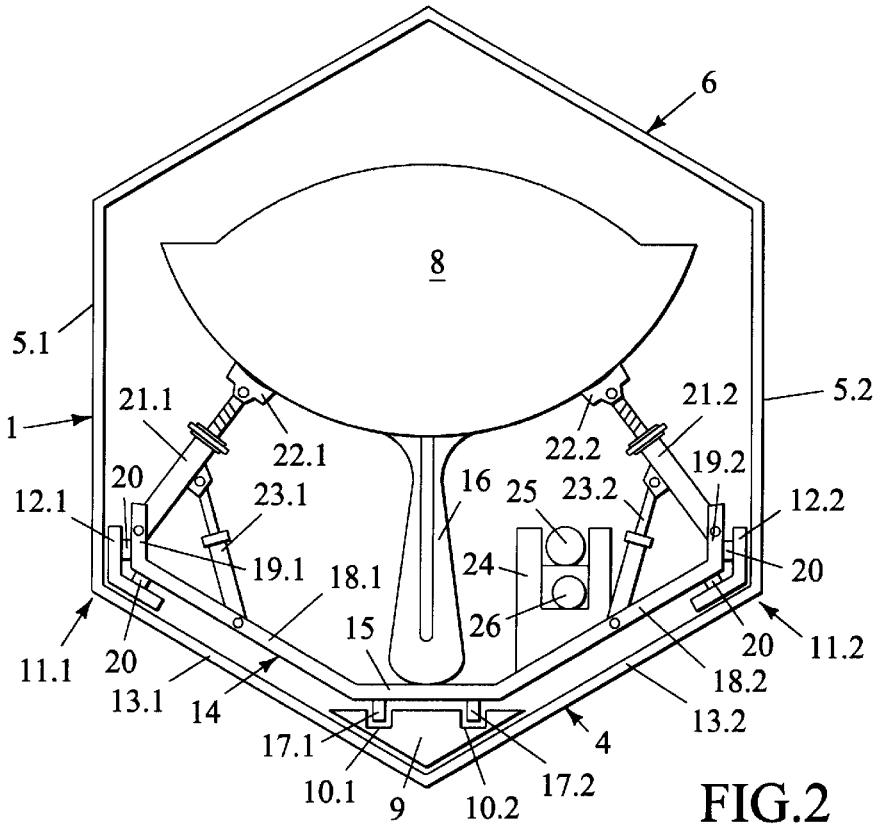
Figure 3:
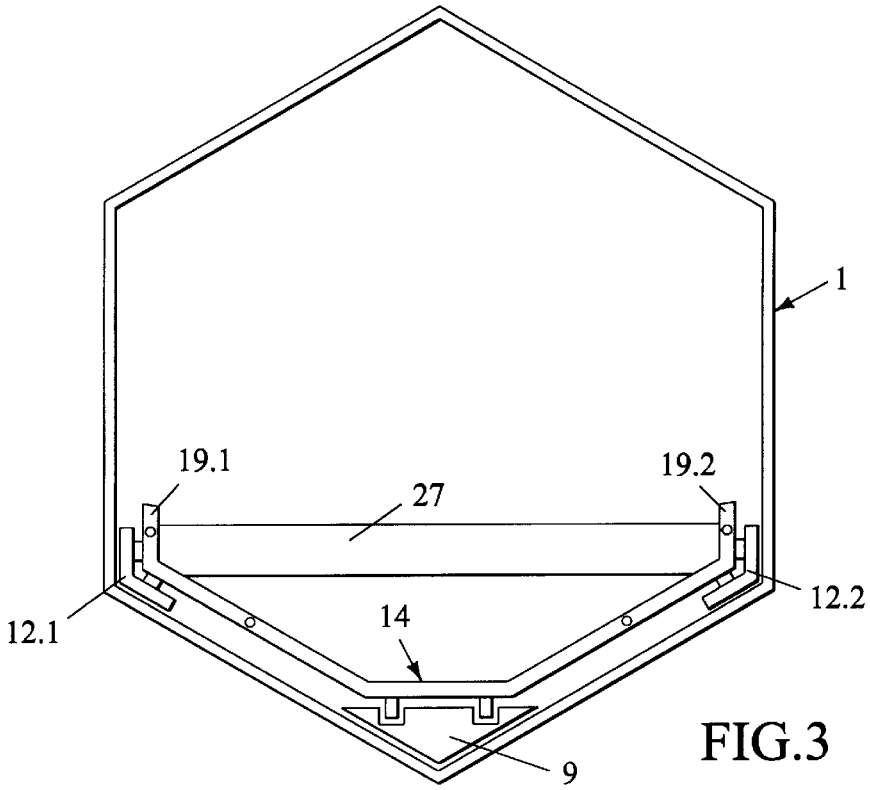
Figure 4:
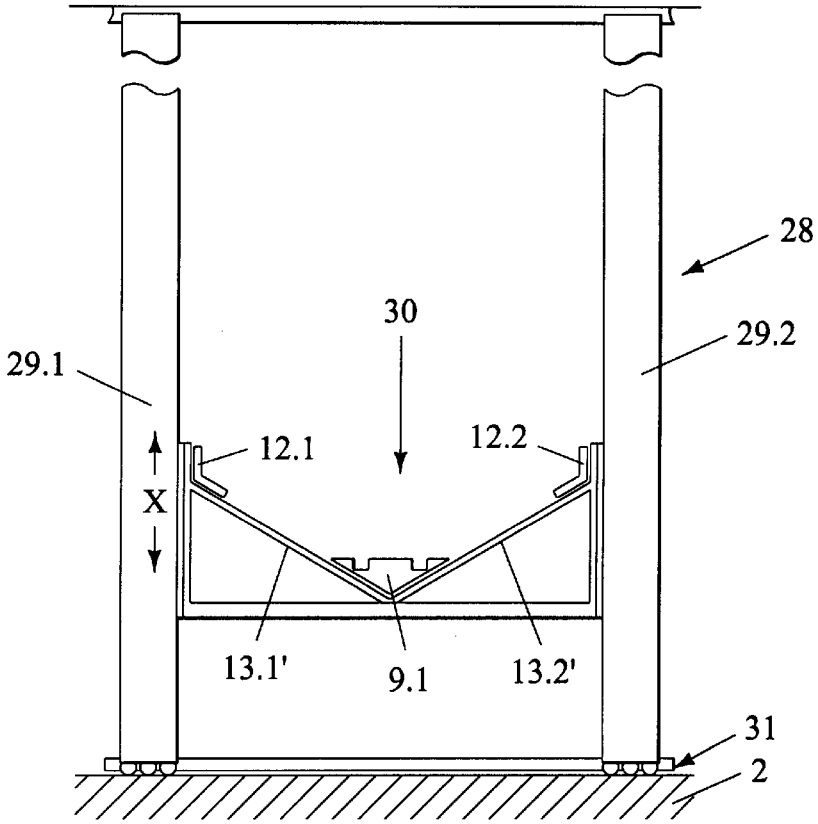

Further advantages, characteristics and details of the invention can be gathered from the following description of the preferred embodiment of the invention as well as on the basis of the drawings which show in FIG. 1 a front view of the installation according to the invention for the storage of objects, especially boats;

FIG. 2 an enlarged view of a single cell of the installation according to FIG. 1, complete with contents;

FIG. 3 a view of a further embodiment of the cell according to FIG. 2 without contents;

FIG. 4 a schematic view of the lifting device

Figure 5:
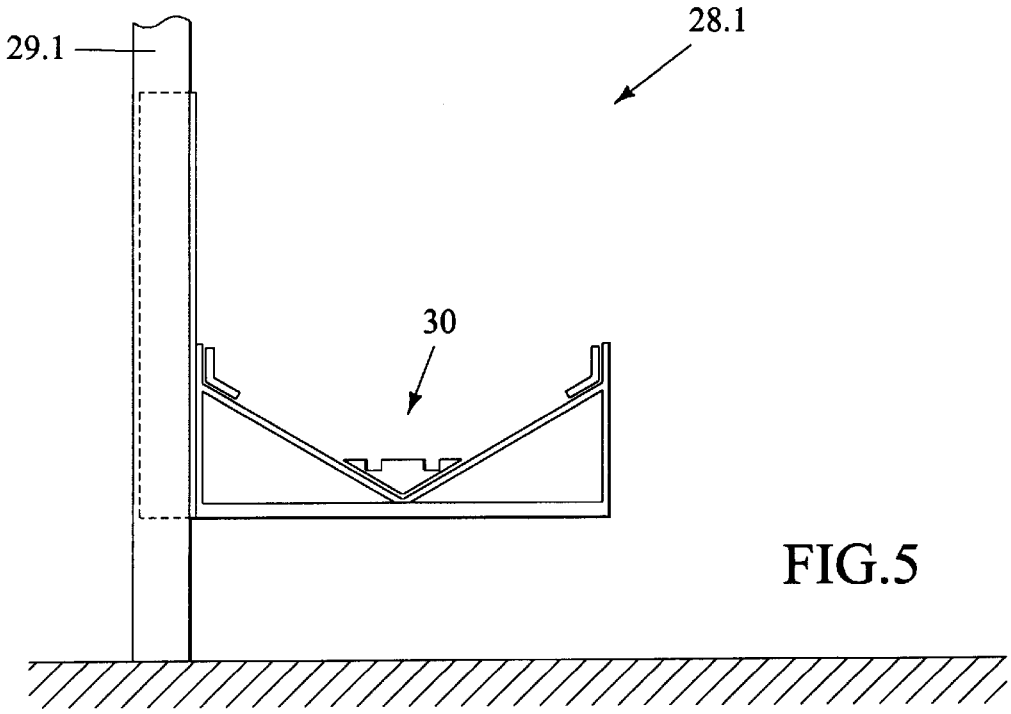
Figure 6:
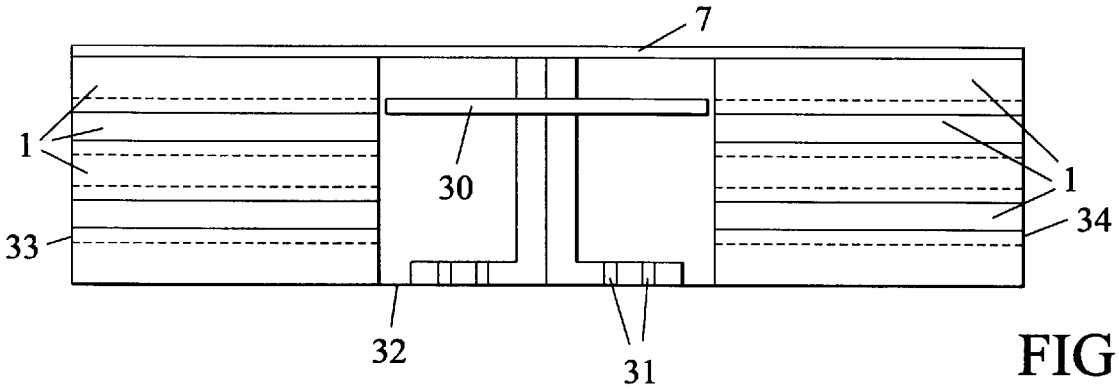
Figure 7:
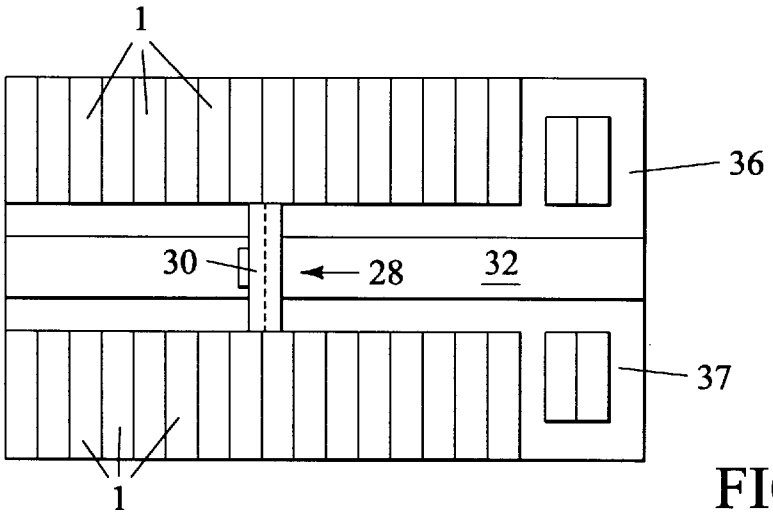

FIG. 5 a further embodiment of the lifting device according to FIG. 4;

FIG. 6 a schematic side view of a possible arrangement of cells and lifting devices;

FIG. 7 a view of a possible arrangement of cells and lifting devices according to FIG. 6.

According to FIG. 1, the installation R according to the invention for the storage of objects, in particular boats, shows numerous cells 1. These cells 1 are preferably formed as hexagons and are arranged next to and above each other as shown, so that a honeycomb structure is formed. Here, if necessary, stabilising blocks 3, which are firmly attached to the ground 2, are arranged next to each other, whereby between two stabilising blocks 3 a cell 1 is placed as shown.

Each single honeycomb formed cell 1 is provided with a triangular base element 4 from which walls 5.1, 5.2 rise vertically on which a symmetrical to the base element 4 triangular roof element 6 connects. The individual cells 1 are in the longitudinal direction tubular in form whereby, if necessary the back wall is closed in order to achieve a greater torsional stiffness.

As shown in FIG. 1, the individual cells 1 are arranged in several layers E1 to E5 above each other, each layer being shifted in respect to it's neighbour. Due to the honeycomb arrangement of the individual cells 1 the installation R attains a very high stability in order to support high loads. Finally, the installation R can be covered by a hall roof 7.

It is ensured due to this special arrangement that a large number of objects, especially boats 8, can be stored in the individual cells 1 in the smallest possible space.

According to FIG. 2, a beam 9 is placed approximately in the middle of the triangular section of the base element 4. This beam 9 displays guide slots 10.1, 10.2, which preferably extend over the entire length of the cell. The beam 9 is preferably firmly attached to the base element 4.

Further to this, in the corner regions 11.1, 11.2 between base element 4 and wall 5.1 and base element 4 and wall 5.2 respectively guide rails 12.1, 12.2 are placed which extend over the entire length of the cell 1. Here the guide rails 12.1, 12.2 extend over the corner regions 11.1, 11.2 which join the sides 13.1, 13.2 of the base element 4 with the walls 5.1, 5.2.

A storage trolley 14 according to the invention is applied in the cell 1 in a insertable and extractable manner.

The storage trolley 14 displays a base plate 15 on which the keel 16 of the boat 8 is supported. Beneath the base plate 15 transport rollers 17.1, 17.2 spaced at a certain distance apart are provided which fit in the guide slots 10.1, 10.2 of the beam 9. The storage trolley 14 is guided in the guide slots 10.1, 10.2.

Parallel lateral brackets 18.1, 18.2 extend from the base plate 15 running appropriately to suit the sides 13.1, 13.2 until they reach the corner regions 11.1, 11.2 and then they are bent upwards and run parallel to the walls 15.1, 15.2 as short arms 19.1, 19.2.

The lateral brackets 18.1, 18.2 and the arms 19.1, 19.2 are provided with rotary rollers 20 in the corner regions 11.1, 11.2 which face outwards. These rollers 20 support the storage trolley 14 against the guide rails 12.1, 12.2. In this manner an exact positioning and guiding is achieved in order to insert or extract the storage trolley 14 into or out of the cell 1.

To secure the boat 8 in the storage trolley 14 from tipping over it is preferred that the adjustable supports 21.1, 21.2 be mounted to the arms 19.1, 19.2 forming an articulated joint. On the opposite ends of the adjustable supports 21.1, 21.2 blocks 22.1, 22.2, which support the hull of the boat, are mounted forming articulated joints.

The supports 21.1, 21.2 formed, especially in the case of sailing yachts, to suit the form of the hull and the appropriate length of the keel 16. In addition, the supports 21.1, 21.2 provided with adjustable struts 23.1, 23.2 which are connected to the lateral brackets 18.1, 18.2 at articulated joints. Therefore, the position of the supports 21.1, 21.2 can be appropriately adapted to accommodate, for example, very narrow or very wide hulls of boats. The supports 21.1, 21.2 and also the struts 23.1, 23.2 can hereby be adjusted mechanically, or also pneumatically, hydraulically or electrically.

Preferably the base plate 15 is approximately as long as the cell 1 or as long as the hull of the boat whereby at the front end of the base plate in the bow region of the boat, which is not shown on the drawings, appropriately formed lateral brackets are provided in similar fashion to the stern region of the boat. Therefore the hull of the boat 8 is supported by at least four supports. This type of storage is also suitable for motor boats, whereby it is also planed in this instance to adapt the supports 21.1, 21.2 to suit the hull and if necessary to make them lower. For this reason, the supports 21.1, 21.2 and the struts 23.1, 23.2, which are mounted on the arms 19.1, 19.2 or the lateral brackets 18.1, 18.2 respectively, can be fitted at different positions.

Mounting blocks 24 are arranged, in particular for sailing yachts, on the storage trolley 14 onto which, for example, a mast 25 or a boom 26 can be laid down.

A further embodiment of the present invention according to FIG. 3 shows the storage trolley 14 as displayed in FIG. 2 without supports 21.1, 21.2 and struts 23.1, 23.2. On the other hand, a pallet 27 is placed between the arms 19.1, 19.2 on which different types of objects can be laid down.

This is in particular the case when, for example, the boats are in the water and the cells 1 can be used as storage for common types of goods.

In order to be able to extract the storage trolley 14 for the accommodation of a boat from the cell 1 in one of the levels, E1 to E5, a lifting device 28, which is shown in FIG. 4 and 5, must be inserted into the cell 1 to lift up the storage trolley 14. The lifting device 28 displays neighbouring guide columns 29.1, 29.2 which are connected to each other and serve to accommodate a lift 30 which is provided between them.

The lift 30 is adjustable in it's height along the guide columns 29.1, 29.2 as indicated by the double arrows X. The lift 30 is provided with a beam 9.1, which matches the beam 9 of the cell 1, as well as being provided with sides 13.1', 13.2' and the guide rails 12.1', 12.2', which are identical to the corresponding elements in the cell 1. For this reason, a transfer of the storage trolley 14 from the cell 1 to the lift 30 is achievable without difficulties.

Further, the lifting device 28 can be driven backwards and forwards along a rail system 31, which runs on the floor 2. Consequently, every possible cell 1 can be accessed. The lift 30 is then driven to a point opposite the base element 4 of the cell 1 and subsequently, the storage trolley 14 is driven out of the cell 1 onto the lift 30 of the lifting device. Also in reverse if necessary, a loaded storage trolley 14 can be driven into a cell 1. In order to prevent the lifting device 28 from tipping over in such situations, due to instability, several guide columns can be arranged behind each other.

FIG. 5 shows another lifting device 28.1 with only one guide column 29.1 on which the lift 30 can be driven. This is adequate for lighter boats 8.

FIG. 6 shows an installation with cells arranged above each other which are arranged on both sides of the lifting device driveway 32. Using the lift 30, whose height can be adjusted, the individual cells 1 can be loaded or unloaded. In order to protect the individual cells from the weather, the cells can be covered by the side walls 33, 34 and the roof 7.

As shown in FIG. 7, the individual cells 1 grouped together in regions on both sides of the lifting device driveway 32 whereby it is also intended that additional working areas 36, 37, are provided in order to repair or maintain boats or other objects.

An especially effective embodiment of the invention is given when for example the lifting device runs directly into the water and a boat ramp is provided in order to transport boats directly out of the water into the individual cells.

I claim:

1. Apparatus for the storage of boats (8) in individual cells (1) with hexagonal cross section and vertical symmetry comprising a plurality of cells (1), which stand vertically on one of their hexagonal corners adjacent to each other and, on vertical orientation, shifted in respect to each other, and joined together to form a honeycomb rack system without spaces between the cells and is operated in the fashion of a high rack warehouse with several rack layers, wherein selected hexagonal cells (1) are provided with at least one separate storage element in the form of a storage trolley (14) which is adapted to the hexagonal geometry which accommodates the boats and can, by means of a rack service system, be moved out of the cell (1) and back in again, in that the storage trolley (14) is movably mounted on a beam (9) which in turn is mounted in the base element (4), a base plate (15) of the storage trolley (14) is allocated transport rollers (17.1, 17.2), which run in guide slots (10.1, 10.2) of the beam (9).

2. Apparatus according to claim 1 further comprising lateral brackets (18.1, 18.2) from which arms (19.1, 19.2) protrude and are connected to the base plate (15).

3. Apparatus according to claim 1 wherein the storage trolley (14) further comprises supports (21.1, 21.2).

4. Apparatus according to claim 3 wherein the supports (21.1, 21.2) are adjustable in length, and whereon the supports (21.1, 21.2) are connected to the arms (19.1, 19.2) of the storage trolley (14) at articulated joints and are adjustable in their position using struts (23.1, 23.2) which are adjustable in their length.

5. Apparatus according to claim 1 further comprising a guide rail (12.1, 12.2) in at least one corner region (11.1, 11.2) between sides (13.1, 13.2) and walls (5.1, 5.2) of the cell (1).

6. Apparatus according to claim 1 further comprising on the storage trolley (14) at least one mounting block (24) to accommodate at least one mast (25) or boom (26).

7. Apparatus according to claim 1 wherein the storage trolley (14) is movable into and out of the cell (1) by manual and/or motorized means.

8. Apparatus according to claim 1 further comprising triangular supporting blocks (3) arranged next to each other on a floor (2) to form a base for a plurality of cells (1).

9. Apparatus according to claim 8 wherein between each neighbouring supporting block (3), at least one cell (1) at a level (E1) is disposed.

10. Apparatus according to claim 1 wherein any cell (1) in any layer (E1 to E5) can be reached by means of a lift (30) which is allocated to a lifting device (28).

11. Apparatus according to claim 10 wherein the lifting device (28) is provided with at least one guide column (29.1, 29.2), whereby the lift (30) is arranged on the guide columns (29.1, 29.2) in such a manner that the height of the lift (30) can be adjusted.

12. Apparatus according to claim 11 wherein the inner contour of the lift (30) is formed to suit the base element (4) of the cell (1) in order to receive the storage trolley (14).

13. Apparatus according to claim 10 wherein on both sides of the lifting device (28) a plurality of cells are arranged, whereby the lifting device (28) is transportable along a lifting device driveway (32) and the cells which are arranged on both sides adjacent to each other are accessible using the lift (30) of the lifting device (28).

14. Apparatus according to claim 11 herein the storage trolley (14) is provided with at least one palette (27) for the accommodation of objects.

* * * * *